US012716633B2

(12) United States Patent
Hellmann et al.

(10) Patent No.: US 12,716,633 B2
(45) Date of Patent: Aug. 25, 2026

(54) REFRIGERATION CIRCUIT WITH THERMAL STORAGE

(71) Applicant: Carrier Corporation, Palm Beach Gardens, FL (US)

(72) Inventors: Sascha Hellmann, Hochheim am Main (DE); Subramanyaravi Annapragada, Alpharetta, GA (US); Rebecca Shen, Avon, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 196 days.

(21) Appl. No.: 18/538,472

(22) Filed: Dec. 13, 2023

(65) Prior Publication Data

US 2024/0200841 A1 Jun. 20, 2024

Related U.S. Application Data

(60) Provisional application No. 63/387,665, filed on Dec. 15, 2022.

(51) Int. Cl.
*F25B 49/02* (2006.01)

(52) U.S. Cl.
CPC ..... *F25B 49/02* (2013.01); *F25B 2400/24* (2013.01); *F25B 2700/15* (2013.01)

(58) Field of Classification Search
CPC ..... F25B 2400/051; F25B 2400/053; F25B 2400/054; F25B 2400/13; F25B 2400/23;
(Continued)

(56) References Cited

U.S. PATENT DOCUMENTS 6,220,337 B1 4/2001 Chen et al.
9,212,834 B2 12/2015 Parsonnet et al.
(Continued)

FOREIGN PATENT DOCUMENTS

EP 0402131 B1 10/1993
EP 3961123 A1 3/2022
(Continued)

OTHER PUBLICATIONS

Extended European Search Report received for EP Application No. 23217289.0, mailed on Feb. 19, 2024, 7 Pages.

*Primary Examiner* — Henry T Crenshaw
(74) *Attorney, Agent, or Firm* — Drew Folgmann

(57) ABSTRACT

A refrigeration circuit with thermal storage is disclosed. The circuit refrigeration comprises a gas-cooler comprising an inlet, and an outlet, and a compressor unit comprising one or more compressors. The outlet of the compressor unit is fluidically connected to the inlet of the gas-cooler. The refrigeration circuit comprises evaporators comprising an inlet, and an outlet, where the outlet of the evaporators is fluidically coupled to the inlet of the compressor unit. The refrigeration circuit comprises a flash tank fluidically connected between the gas-cooler and the compressor unit, and the evaporators and the compressor unit. Further, the circuit refrigeration comprises a thermal battery fluidically coupled to the gas-cooler, the flash tank, the compressor unit, and the evaporators. The thermal battery is used as a heat source and a heat sink based on the energy pricing of an electric grid to optimize the operation of the gas-cooler, evaporators, and the compressors.

20 Claims, 7 Drawing Sheets

(58) Field of Classification Search
CPC .. F25B 2400/24; F25B 2700/15; F25B 41/20; F25B 49/02; F25B 9/008
See application file for complete search history.

(56) References Cited

U.S. PATENT DOCUMENTS

| | | | | |
|---|---|---|---|---|
| 9,482,117 | B2 | 11/2016 | Davidson et al. | |
| 9,903,621 | B1 | 2/2018 | Goel et al. | |
| 9,989,271 | B1 | 6/2018 | Becker | |
| 10,443,900 | B2 | 10/2019 | Kujak et al. | |
| 10,767,909 | B2 | 9/2020 | Zha et al. | |
| 11,073,311 | B2 | 7/2021 | Warner et al. | |
| 11,149,971 | B2 * | 10/2021 | Ignatiev | F25B 1/10 |
| 11,441,824 | B2 | 9/2022 | Street et al. | |
| 2009/0293507 | A1 | 12/2009 | Narayanamurthy et al. | |
| 2014/0230477 | A1 * | 8/2014 | Furui | F24D 5/02 62/434 |
| 2017/0211862 | A1 * | 7/2017 | Slack | F24H 15/414 |
| 2019/0242657 | A1 | 8/2019 | Ignatiev et al. | |
| 2020/0348056 | A1 * | 11/2020 | Street | F25B 9/008 |

FOREIGN PATENT DOCUMENTS

| | | | |
|---|---|---|---|
| EP | 3995761 | A1 | 5/2022 |
| WO | 202297680 | A1 | 5/2022 |
| WO | 2022166381 | A1 | 8/2022 |

* cited by examiner

200

REFRIGERATION CIRCUIT WITH THERMAL STORAGE

CROSS-REFERENCE TO RELATED APPLICATION

This patent application claims the benefit of U.S. Provisional Patent Application No. 63/387,665, filed on Dec. 15, 2022, which is incorporated by reference herein in its entirety.

BACKGROUND

This invention relates to the field of refrigeration circuits, and more particularly, an improved, reliable, and power-efficient refrigeration circuit.

Existing refrigeration circuits generally have refrigeration installations operating in dry expansion with superheat, where superheat section in the evaporators may have significantly lower heat transfer efficiency. In addition, compressors of existing refrigeration circuits may be needed to be operated in direct expansion mode to protect the compressor from liquid refrigerant which may harm the bearings of the compressors. Moreover, carbon dioxide ($CO_2$)-based refrigeration systems may operate less efficiently in summer or hot ambient conditions due to the thermodynamics of $CO_2$. As a result, high exit temperature at the outlet of the gas-cooler in the refrigeration circuit may result in more flash vapor, thereby requiring more compressors to run the refrigeration circuit.

SUMMARY

Described herein is a refrigeration circuit comprising a gas-cooler comprising an inlet and an outlet, and a compressor unit comprising one or more compressor, wherein an outlet of the compressor unit is fluidically connected to the inlet of the gas-cooler. The refrigeration circuit further comprises one or more evaporators, each comprising an inlet, and an outlet, wherein the outlet of the one or more evaporators is fluidically coupled to the inlet of the compressor unit. The refrigeration circuit further comprises a flash tank fluidically connected between one or more of the gas-cooler and the compressor unit, and the one or more evaporators and the compressor unit. Further, the refrigeration circuit comprises one or more thermal battery fluidically coupled to the gas-cooler, the flash tank, the compressor unit, and the one or more evaporators.

In one or more embodiments, the circuit comprises a controller operatively coupled to one or more components of the refrigeration circuit, wherein the controller is configured to monitor one or more parameters associated with the refrigeration circuit, and control operation of the one or more components of the refrigeration circuit.

In one or more embodiments, the controller is in communication with a database associated with one or more electric power service provider, wherein the controller is configured to: receive, from the database, data pertaining to electricity grid information associated with an electrical grid connected to the refrigerant circuit, and control, based on the electricity grid information, the flow of a refrigerant associated with the refrigeration circuit between one or more of the gas-cooler and the thermal battery, the thermal battery and the one or more evaporator, and/or the thermal battery and the compressor unit.

In one or more embodiments, when the electricity pricing is below a predefined level, the controller enables the flash tank via a dedicated valve to supply and evaporate the refrigerant in the thermal battery to cool a buffer associated with the thermal battery at a first temperature and act as a heat source.

In one or more embodiments, when temperature at the outlet of the gas-cooler exceeds a predefined temperature and/or when the electricity pricing is above the predefined level, the buffer of the thermal battery acting as the heat sink is melted to cool the refrigerant flowing therethrough, wherein the cooled refrigerant is supplied to the outlet of the gas-cooler to reduce the temperature at the outlet of the gas-cooler below the predefined temperature.

In one or more embodiments, when the electricity pricing is above the predefined level, the controller enables melting of the buffer acting as the heat sink to cool the refrigerant flowing therethrough to a second temperature and further supply the cooled refrigerant to the one or more evaporators.

In one or more embodiments, the controller is configured to enable the flow of the refrigerant being heated in the refrigeration circuit, through the thermal battery to store thermal energy of the heated refrigerant in the buffer such that the thermal battery acts as a heat source.

In one or more embodiments, the controller is configured to enable the thermal battery acting as the heat source to heat the refrigerant flowing therethrough to a super-heated temperature; and supply the super-heated refrigerant from the thermal battery to the compressor unit.

Also described herein is a refrigeration circuit comprising a gas-cooler comprising an inlet, and an outlet, and a compressor unit comprising one or more compressor, wherein the outlet of the compressor unit is fluidically coupled to the inlet of the gas-cooler. The refrigeration circuit further comprises a thermal battery comprising a first inlet, a first outlet, a second inlet, and second outlet, wherein the gas-cooler is fluidically coupled to the thermal battery. Further, the refrigeration circuit comprises a flash tank comprising an inlet, a vapor outlet, and a liquid outlet, wherein the vapor outlet of the flash tank is fluidically coupled to an inlet of the compressor unit via a heat exchanger. The refrigeration circuit further comprises one or more evaporators, each comprising an inlet, and an outlet, wherein, the second inlet of the thermal battery is fluidically coupled to the outlet of the one or more evaporator, the vapor outlet and the liquid outlet of the flash tank are fluidically coupled to the inlet of the one or more evaporators via the heat exchanger and a first expansion valve, the vapor outlet and the liquid outlet of the flash tank are fluidically coupled to the second inlet of the thermal battery via the heat exchanger and a second expansion valve, and the second outlet of the thermal battery is fluidically coupled to the inlet of the compressor unit.

In one or more embodiments, wherein the refrigeration circuit comprises a three-way valve comprising a first port, a second port, and a third port, wherein, the first port of the three-way valve is fluidically coupled to the outlet of the gas-cooler, the first outlet of the thermal battery is fluidically coupled to the second port of the three-way valve, the third port of the three-way valve is fluidically coupled to the inlet of the flash tank, and the outlet of the gas-cooler is fluidically coupled to the first inlet of the thermal battery.

In one or more embodiments, the refrigeration circuit comprises a controller in communication with a database associated with one or more electric power service provider, wherein the controller is configured to receive, from the database, data pertaining to electricity grid information associated with an electrical grid connected to the refrigerant circuit, and control, based on the electricity grid information, the flow of a refrigerant associated with the refrigeration circuit between one or more of the gas-cooler and the thermal battery, the thermal battery and the one or more evaporator, and/or the thermal battery and the compressor unit.

In one or more embodiments, when an electricity pricing of the electric grid is below a predefined level, the controller enables the flash tank to supply and evaporate the refrigerant in the thermal battery to cool a buffer associated with the thermal battery at a first temperature and act as a heat source.

In one or more embodiments, when temperature at the outlet of the gas-cooler exceeds a predefined temperature and/or when the electricity pricing is above the predefined level, the buffer of the thermal battery acting as the heat sink is melted to cool the refrigerant flowing therethrough, wherein the cooled refrigerant is supplied to the outlet of the gas-cooler via the three-way valve to reduce the temperature at the outlet of the gas-cooler below the predefined temperature.

In one or more embodiments, when the electricity pricing is above the predefined level, the controller enables melting of the buffer acting as the heat sink to cool the refrigerant flowing therethrough to a second temperature and further supply the cooled refrigerant to the one or more evaporators.

In one or more embodiments, the controller is configured to enable the thermal battery acting as the heat source to heat the refrigerant flowing therethrough to a super-heated temperature, and supply the super-heated refrigerant from the thermal battery to the compressor unit.

Further described herein is a refrigeration circuit comprising a gas-cooler comprising an inlet, and an outlet, and a compressor unit comprising one or more compressor, wherein the outlet of the compressor unit is fluidically coupled to the inlet of the gas-cooler. The refrigeration circuit further comprises a thermal battery comprising an inlet and an outlet, wherein the outlet of the gas-cooler is fluidically coupled to the inlet of the thermal battery via a first heat exchanger, and a second heat exchanger. The refrigeration circuit further comprises a flash tank comprising an inlet, a vapor outlet, and a liquid outlet, wherein the third port of the three-way valve is fluidically coupled to the inlet of the flash tank via the first heat exchanger, and the vapor outlet of the flash tank is fluidically coupled to an inlet of the compressor unit via a third heat exchanger. Further, the refrigeration circuit further comprises one or more evaporators, each comprising an inlet, and an outlet, wherein the inlet of the thermal battery is fluidically coupled to the outlet of the one or more evaporators via the second heat exchanger; the liquid outlet and the vapor outlet of the flash tank are fluidically coupled to the inlet of the one or more evaporator via the heat exchanger, and a first expansion valve; the liquid outlet and the vapor outlet of the flash tank are fluidically coupled to the inlet of the thermal battery via the second heat exchanger, the second heat exchanger, and a second expansion valve; and the outlet of the thermal battery is fluidically coupled to the inlet of the compressor unit.

In one or more embodiments, wherein the refrigeration circuit comprises a three-way valve comprising a first port, a second port, and a third port, wherein, the first port of the three-way valve is fluidically coupled to the inlet of the thermal battery via the second heat exchanger, the second port of the three-way valve is fluidically coupled the outlet of the thermal battery, the third port of the three-way valve is fluidically coupled to the inlet of the flash tank via the first heat exchanger, and the outlet of the thermal battery is fluidically coupled to the inlet of the compressor unit via the three-way valve and the second heat exchanger.

The foregoing summary is illustrative only and is not intended to be in any way limiting. In addition to the illustrative aspects, embodiments, and features described above, further aspects, embodiments, features, and techniques of the invention will become more apparent from the following description taken in conjunction with the drawings.

BRIEF DESCRIPTION OF THE DRAWINGS

The accompanying drawings are included to provide a further understanding of the subject disclosure of this invention and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

Figure 1:
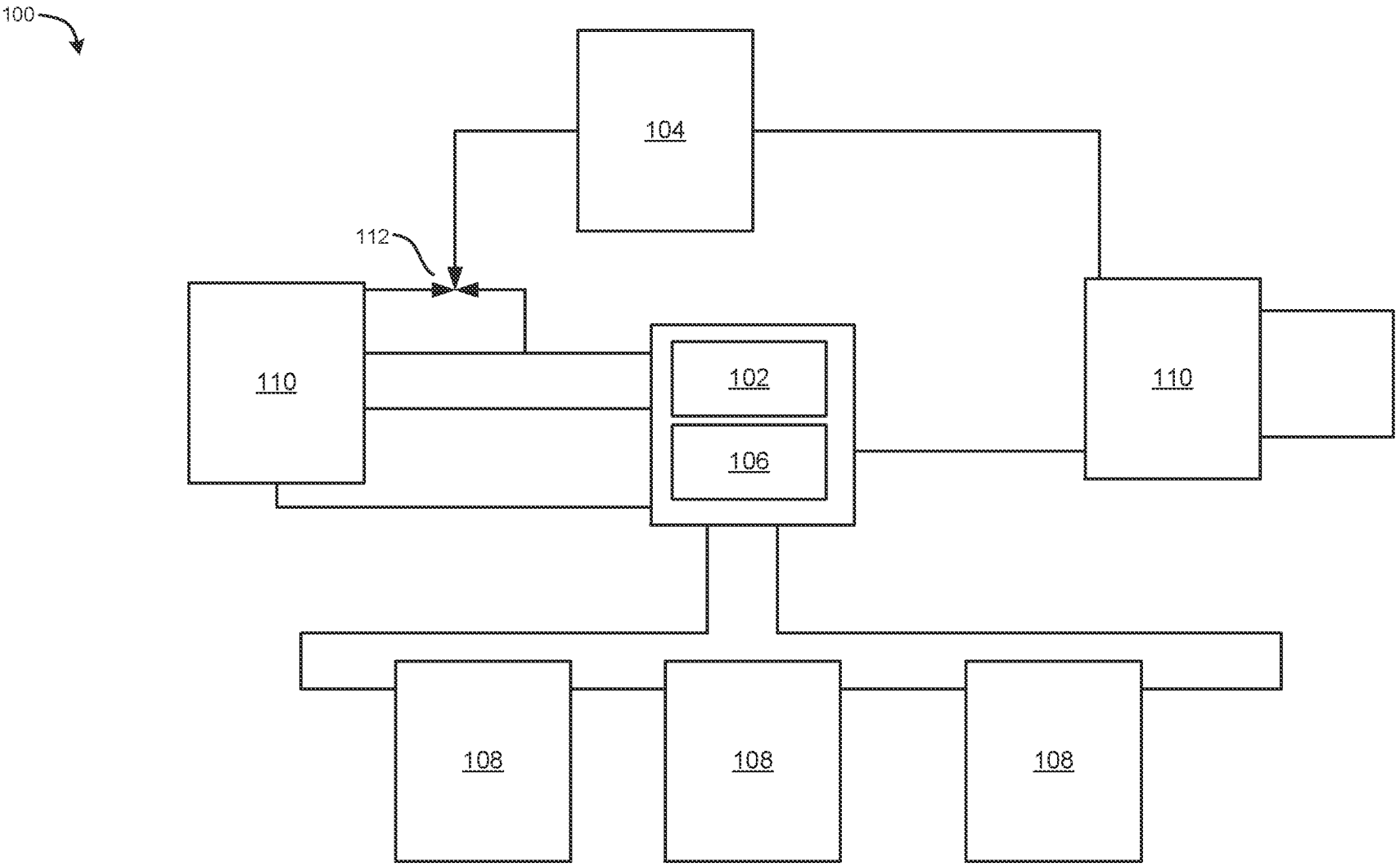
FIG. 1 illustrates an exemplary block diagram of a refrigeration circuit with thermal storage in accordance with one or more embodiments of the disclosure.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

In the specification, reference may be made to the spatial relationships between various components and to the spatial orientation of various aspects of components as the devices are depicted in the attached drawings. However, as will be recognized by those skilled in the art after a complete reading of the subject disclosure, the components of this invention. described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, as the gas-cooler, evaporator, compressor, flash tank, thermal battery, heat exchanger, and corresponding components, described herein may be oriented in any desired direction.

This invention provides an improved, reliable, and power-efficient refrigeration circuit having thermal storage. The refrigeration circuit may comprise a gas-cooler having $CO_2$ as refrigerant, a compressor unit comprising multiple compressors, a flash tank, and one or more evaporators associated with one or more loads such as, but not limited to, refrigeration cabinets. The refrigeration circuit may include a thermal battery having a buffer, which may include a phase-changing material. The refrigeration circuit may allow loading (cooling/freezing) of the buffer when electricity pricing is cheaper and may further allow the buffer to melt against the gas-cooler outlet to reduce the power consumption if the cost of electricity is high or if ambient conditions are on a peak period of the day. Moreover, the refrigeration circuit may allow a lift of evaporation temperature in the refrigeration circuit, which may improve the overall efficiency. The refrigeration circuit may also allow the users to easily retrofit refrigeration cabinets or to size the initial equipment smaller.

Referring to FIGS. 1 to 3B, in one or more embodiments, the refrigeration circuit 100 may include a gas-cooler 104 having an inlet and an outlet. The refrigeration circuit 100 may further include a compressor unit 102 comprising one or more compressors 102. The outlet of the compressors of the compressor unit 102 may be fluidically connected to the inlet of the gas-cooler 104. The gas-cooler 104 may also be referred to as a condenser, which may involve carbon dioxide ($CO_2$) as a refrigerant. The refrigeration circuit 100 may further include one or more evaporators 108 associated with installations such as, but not limited to, refrigeration cabinets associated with supermarkets and households. Each evaporator 108 may include an inlet and an outlet. Further, the refrigeration circuit 100 may include a flash tank 106 comprising an inlet, a vapor outlet, and a liquid outlet. The flash tank 106 comprises the vapor outlet near the top of the flash tank 106 and the liquid outlet near the bottom of the flash tank 106. The flash tank 106 may be fluidically connected between the gas-cooler 104 and the compressor unit 102, and the evaporators 108 and the compressor unit 102. Furthermore, the refrigeration circuit 100 may include one or more thermal batteries 110 fluidically coupled to the gas-cooler 104, the flash tank 106, the compressor unit 102, and the evaporators 108. The detailed operation and connection between the above-mentioned components of the refrigeration circuit 100 have been described later in conjunction with FIGS. 2A, 2B and 3A, 3B.

In one or more operations, a refrigerant, such as $CO_2$, and the like may be circulated through the refrigeration circuit 100. A low-pressure vapor line (using a conduit) may deliver the refrigerant to the compressor(s) 102 in gaseous form. The compressor(s) 102 may then increase the pressure of the refrigerant and deliver high-pressure refrigerant to the condenser or gas-cooler 104 through a high-pressure line. As shown in the pressure/enthalpy (PH) diagram of FIGS. 2C and 3C, the compressor unit 102 increases the pressure and enthalpy of the refrigerant from point 1 to point 2. Further, the pressure and enthalpy of the refrigerant reduce from point 2 to point 3 while passing through the gas-cooler 104. The gas-cooler 104 may be configured to transfer heat from the refrigerant to the environment, reducing the temperature of the refrigerant in the process. This reduction in temperature condenses the refrigerant from a vapor to a liquid phase. The refrigerant leaving the outlet of the gas-cooler 104 may be two-phase, liquid and vapor refrigerant. The majority of the refrigerant may be liquid, with a small amount of vapor remaining. The gas-cooler 104 may comprise two fans which may be configured to blow air through the condenser of the gas-cooler 104 to enhance heat transfer from the refrigerant to the environment, however, it will be appreciated that more or less than two fans can also be present.

The two-phase refrigerant leaving the outlet of the gas-cooler 104 may enter the flash tank 106 through the flash tank inlet. Additionally, a high-pressure valve 116 (HPV) may be installed between the outlet of the gas-cooler 104 and the flash tank inlet. As shown in the PH diagram of FIGS. 2C and 3C, the pressure of the refrigerant reduces from point 3-4 or 3'-4' but enthalpy remains the same. Within the flash tank 106, the two-phase refrigerant may be separated due to gravity into a liquid portion in the lower part of the flash tank 106 and a vapor portion in the upper part of the flash tank 106. The refrigerant in the vapor portion of the flash tank 106 may leave via the vapor outlet and return to the compressor unit 102. As shown in the PH diagram of FIGS. 2C and 3C, the enthalpy of the vapor refrigerant leaving the vapor outlet of the flash tank 106 reduce from point 4-5 but the pressure remains the same. Meanwhile, the refrigerant in the liquid portion leaves the flash tank 106 via the liquid outlet and is delivered to an expansion valve 120, and then enters the evaporator 108. As shown in the PH diagram of FIGS. 2C and 3C, the enthalpy of the liquid refrigerant leaving the vapor outlet of the flash tank 106 increases from point 4-6 but pressure remains the same. Depending on the level of refrigerant expansion achieved, the expansion valve 120 may not be necessary. In this case, a bypass line (not shown) may be employed.

In the evaporator 108, heat may be transferred from the environment to the liquid refrigerant. This heat may cause the refrigerant to vaporize, thereby removing heat from the environment. As shown in the PH diagram of FIGS. 2C and 3C, the enthalpy of the refrigerant leaving the outlet of the evaporator 108 increases from point 7-9 but pressure remains the same. The evaporator 108 may be associated with a refrigeration load such as cabinets, wherein the heat may be transferred from the cabinet storage space to the liquid refrigerant, which may cause the refrigerant to vaporize and cool the cabinet storage space. The resulting refrigerant vapor may leave the evaporator 108 via the outlet of the evaporator 108 and be delivered to the thermal battery and then to the compressors 102 for further compression and circulation in the refrigeration circuit 100.

Figure 2A:
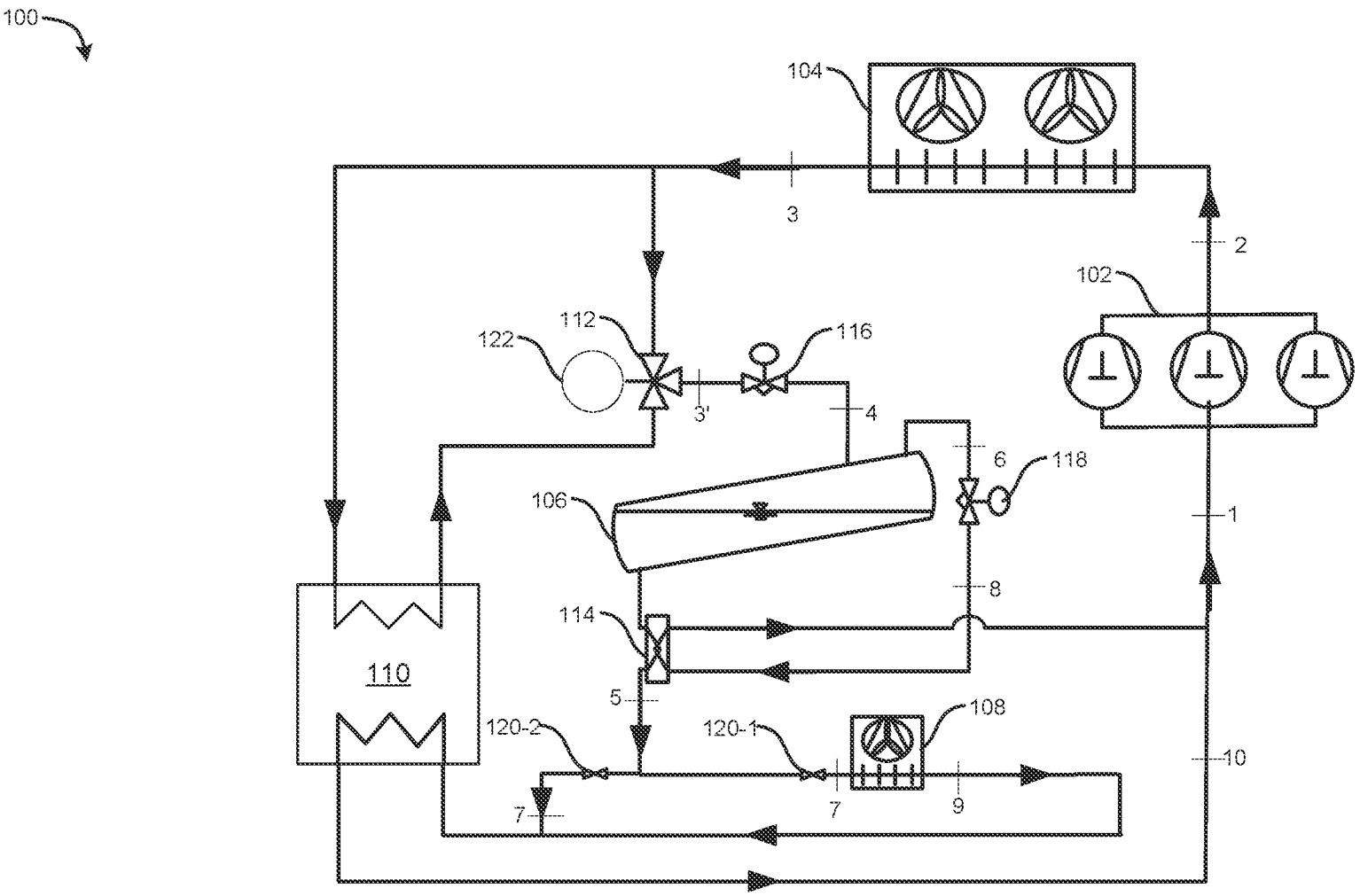
FIGS. 2A and 2B illustrate an exemplary line diagram and block diagram of the refrigeration circuit with thermal storage involving two brazed-plate heat exchangers in accordance with one or more embodiments of the disclosure.
Figure 2B:
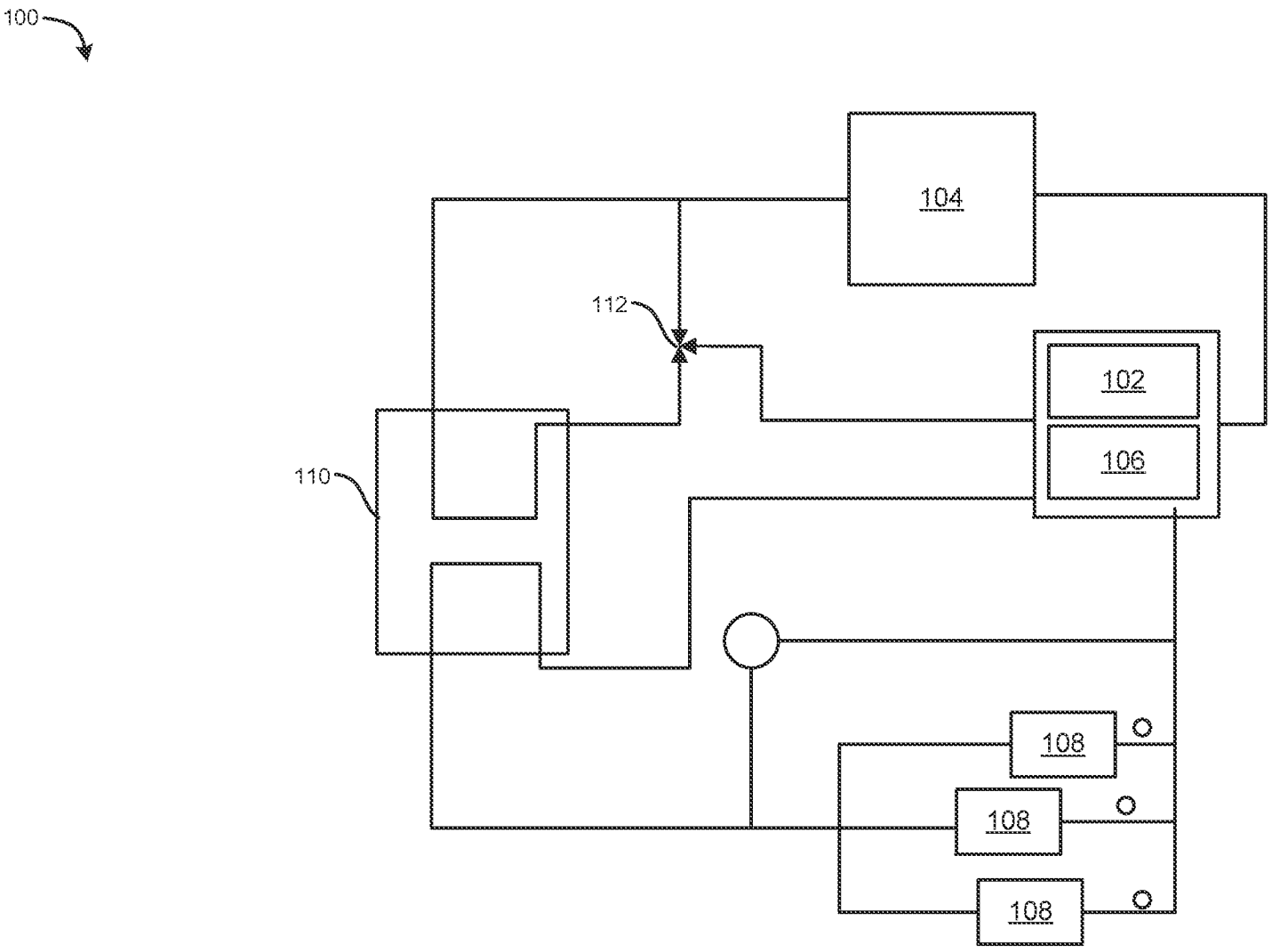

Referring to FIGS. 2A and 2B, the refrigeration circuit 100 may include a thermal battery 110 comprising a first inlet, a first outlet, a second inlet, and a second outlet, which may allow the flow of refrigerant therethrough to allow loading (freezing/cooling) or melting (heating) of a buffer within the thermal battery 110. The outlet of the compressor unit 102 may be fluidically coupled to the inlet of the gas-cooler 104 and the inlet of the compressor unit 102 may be fluidically coupled to the second outlet of the thermal battery 110. In addition, the refrigeration circuit 100 may include a three-way valve 112 comprising a first port, a second port, and a third port. The outlet of the gas-cooler 104 may be fluidically coupled to the first port of the three-way valve 112 as well as the first inlet of the thermal battery 110. The first outlet of the thermal battery 110 may be fluidically coupled to the second port of the three-way valve 112 and the third port of the three-way valve 112 may be fluidically coupled to the inlet of the flash tank 106. Additionally, a high-pressure valve (HPV) 116 may be configured between the outlet of the gas-cooler 104 and the inlet of the flash tank 106.

The vapor outlet of the flash tank 106 may be fluidically coupled to the inlet of the compressor unit 102 via a heat exchanger 114 such as but not limited to a brazed-plate heat exchanger. Additionally, a medium pressure valve (MPV) 118 may be configured between the vapor outlet of the flash tank 106 and the heat exchanger 114. As shown in the PH diagram of FIGS. 2C and 3C, the MPV 118 may lower the pressure of the vapor refrigerant from point 6-8. Further, the second inlet of the thermal battery 110 may be fluidically coupled to the outlet of the one or more evaporators 108. Furthermore, the vapor outlet and the liquid outlet of the flash tank 106 may be fluidically coupled to the inlet of the one or more evaporators 108 via the heat exchanger 114 and a first expansion valve 120-1 (optional). The vapor outlet and the liquid outlet of the flash tank 106 may be fluidically coupled to the second inlet of the thermal battery 110 via the heat exchanger 114 and a second expansion valve 120-1 (optional). As shown in the PH diagram of FIGS. 2C and 3C, the first expansion valve 120-1 may lower the pressure of the refrigerant (coming from the flash tank 106) from point 5-7, but the enthalpy of the liquid refrigerant (point 5-7) remains less than that of the vapor refrigerant (point 6-8) coming from the flash tank 106.

Figure 3A:
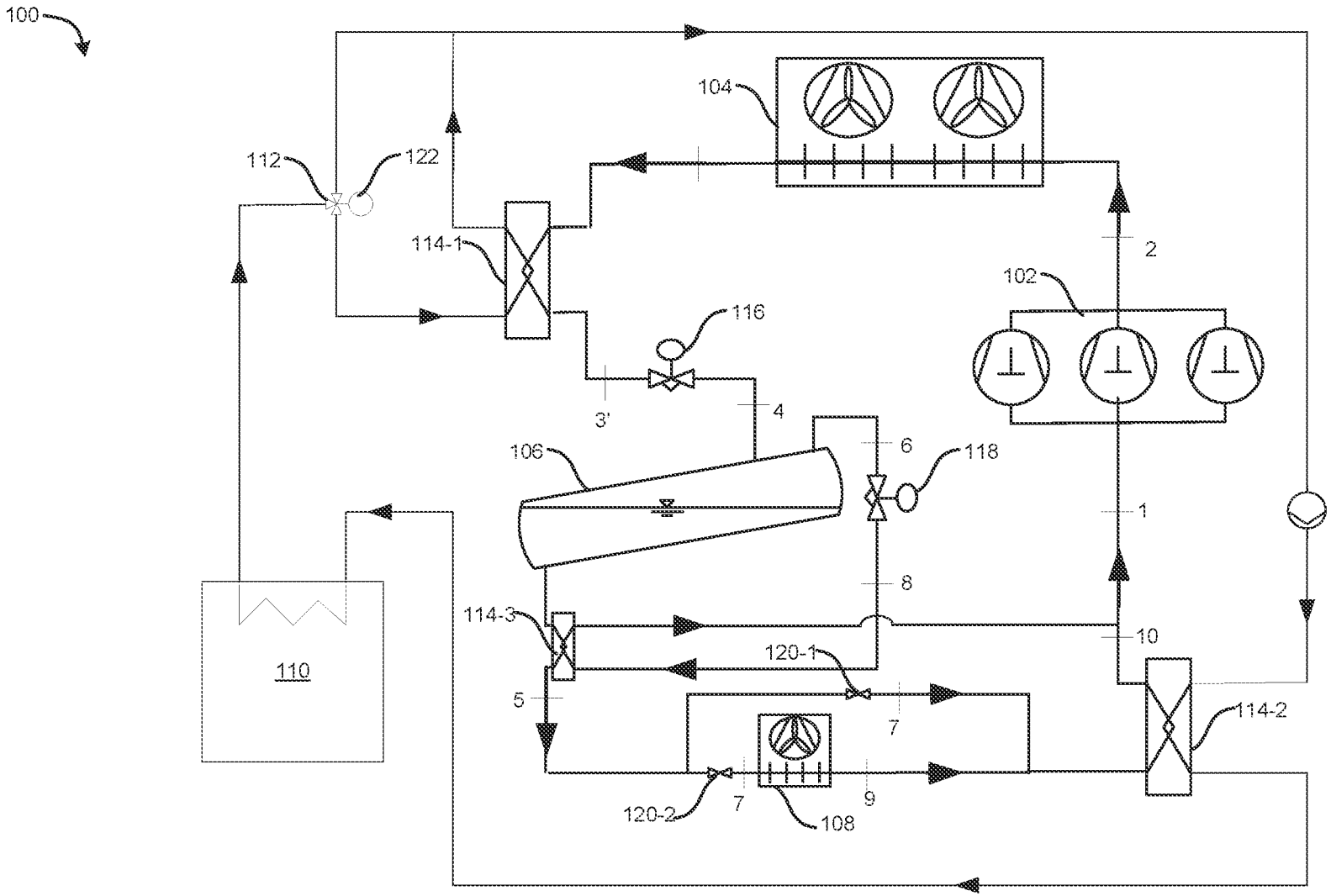
FIGS. 3A and 3B illustrate an exemplary line diagram and block diagram of the refrigeration circuit with thermal storage involving three brazed-plate heat exchangers in accordance with one or more embodiments of the disclosure.
Figure 3B:
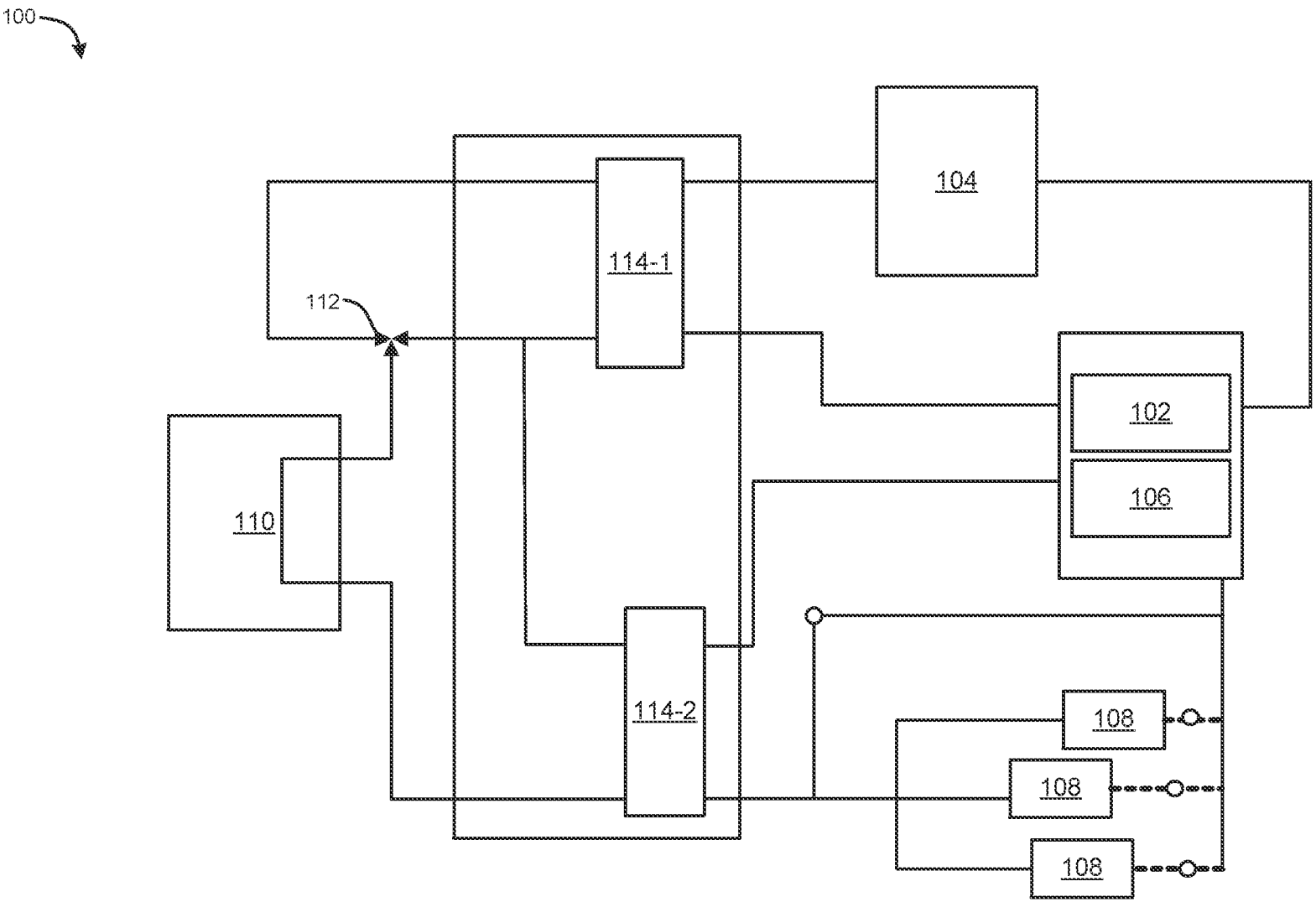

Referring to FIGS. 3A and 3B, the refrigeration circuit 100 may include a thermal battery 110 comprising an inlet, and an outlet, which may allow the flow of refrigerant therethrough to allow loading (freezing/cooling) or melting (heating) of a buffer within the thermal battery 110. The outlet of the compressor unit 102 may be fluidically coupled to the inlet of the gas-cooler 104 and the inlet of the compressor unit 102 may be fluidically coupled to the second outlet of the thermal battery 110. In addition, the refrigeration circuit 100 may include a three-way valve 112 comprising a first port, a second port, and a third port. The outlet of the gas-cooler 104 may be fluidically coupled to the inlet of the thermal battery 110 via a first heat exchanger 114-1, and a second heat exchanger 114-2, which may be a brazed-plate heat exchanger.

The outlet of the thermal battery 110 may be fluidically coupled to the second port of the three-way valve 112 and the outlet of the thermal battery 110 may be further fluidically coupled to the inlet of the compressor unit 102 via the three-way valve 112 and the second heat exchanger 114-2. Further, the first port of the three-way valve 112 may be fluidically coupled to the inlet of the thermal battery 110 via the second heat exchanger 114-2 and the third port of the three-way valve 112 may be fluidically coupled to the inlet of the flash tank 106 via the first heat exchanger 114-1. Additionally, a high-pressure valve (HPV) 116 may be configured between the first heat exchanger 114-1 and the inlet of the flash tank 106.

The vapor outlet of the flash tank 106 may be fluidically coupled to the inlet of the compressor unit 102 via a third heat exchanger 114-3. Additionally, a medium pressure valve (MPV) 118 may be configured between the vapor outlet of the flash tank 106 and the third heat exchanger. As shown in the PH diagram of FIGS. 2C and 3C, the MPV 118 may lower the pressure of the vapor refrigerant from point 6-8. The inlet of the thermal battery 110 may be fluidically coupled to the outlet of the one or more evaporators 108 via the second heat exchanger 114-2. The liquid outlet and the vapor outlet of the flash tank 106 may be fluidically coupled to the inlet of the one or more evaporators 108 via the third heat exchanger 114-3, and a first expansion valve 120-1 (optional). Further, the liquid outlet and the vapor outlet of the flash tank 106 may be fluidically coupled to the inlet of the thermal battery 110 via the second heat exchanger 114-2, the third heat exchanger 114-2, and a second expansion valve 120-1. As shown in the PH diagram of FIGS. 2C and 3C, the first expansion valve 120-1 may lower the pressure of the refrigerant (coming from the flash tank 106) from point 5-7, but the enthalpy of the liquid refrigerant (point 5-7) remains less than that of the vapor refrigerant (point 6-8) coming from the flash tank 106.

Referring back to FIGS. 1 to 3B, in one or more embodiments, the refrigerant leaving the outlet of the gas-cooler 104 and/or the refrigerant leaving the outlet of the evaporator 108 or the flash tank 106 may be allowed to flow through the thermal battery 110 where the buffer of the thermal battery 110 may be loaded or melted based on the temperature of the refrigerant flowing through the thermal battery 110. The flow of the refrigerant between the gas-cooler 104 and the thermal battery 110, the thermal battery 110 and the evaporator 108, and/or the thermal battery 110 and the compressor unit 102 may be controlled based on the ambient temperature at the gas-cooler 104 and/or the electricity grid information associated with an electrical grid connected to the refrigerant circuit.

In one or more embodiments, when the electricity pricing of the electric grid is below a predefined level (electricity is less costly), the flash tank 106 may be operated by the electrical power received from the electrical grid to supply and evaporate the refrigerant in the thermal battery 110 to cool the buffer to a first temperature so that the flash tank 106 may act as a heat sink.

Figure 2C:
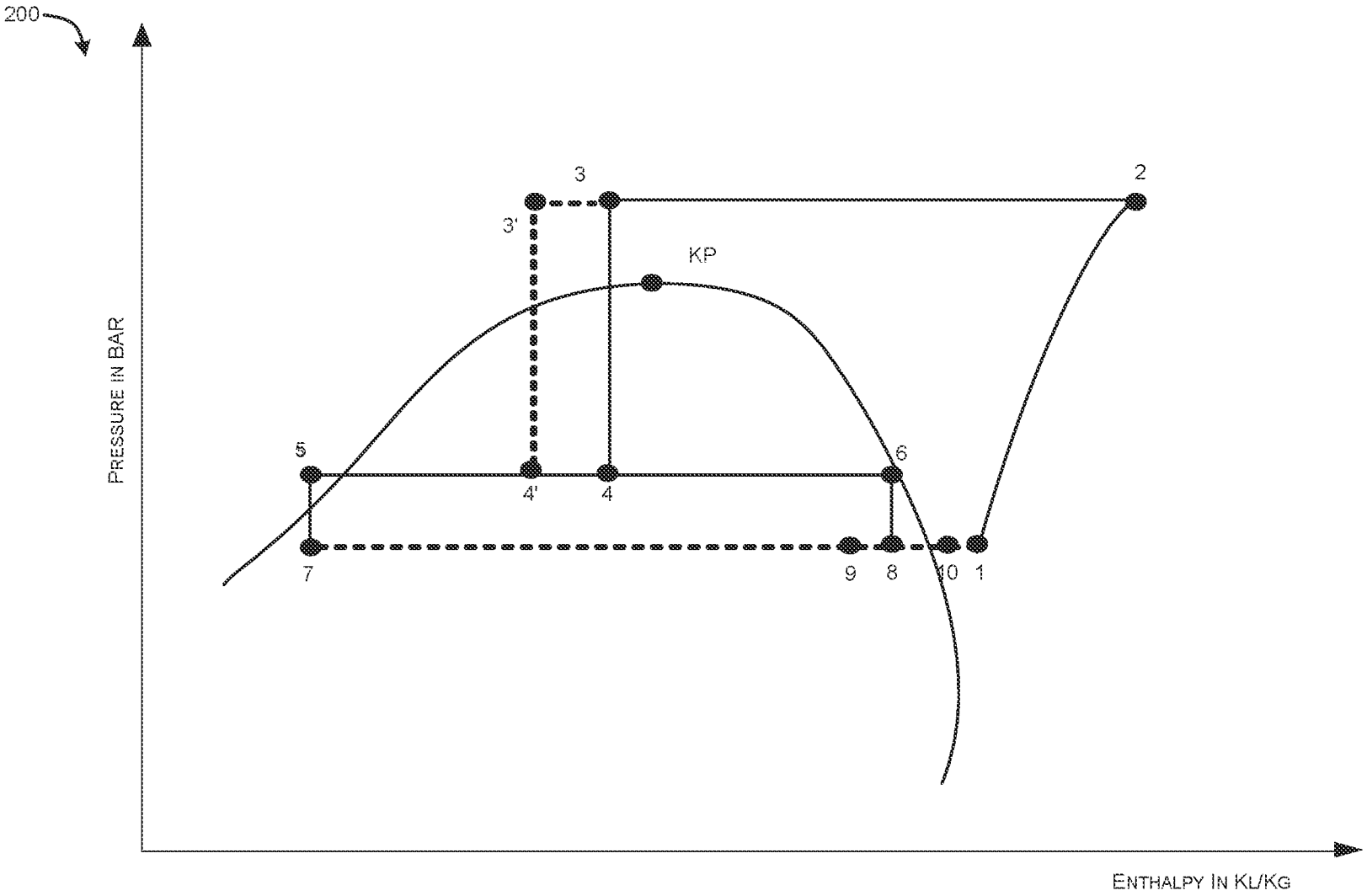
FIG. 2C illustrates an exemplary pressure-heat enthalpy (PH) diagram of the refrigeration circuit of FIGS. 2A and 2B.
Figure 3C:
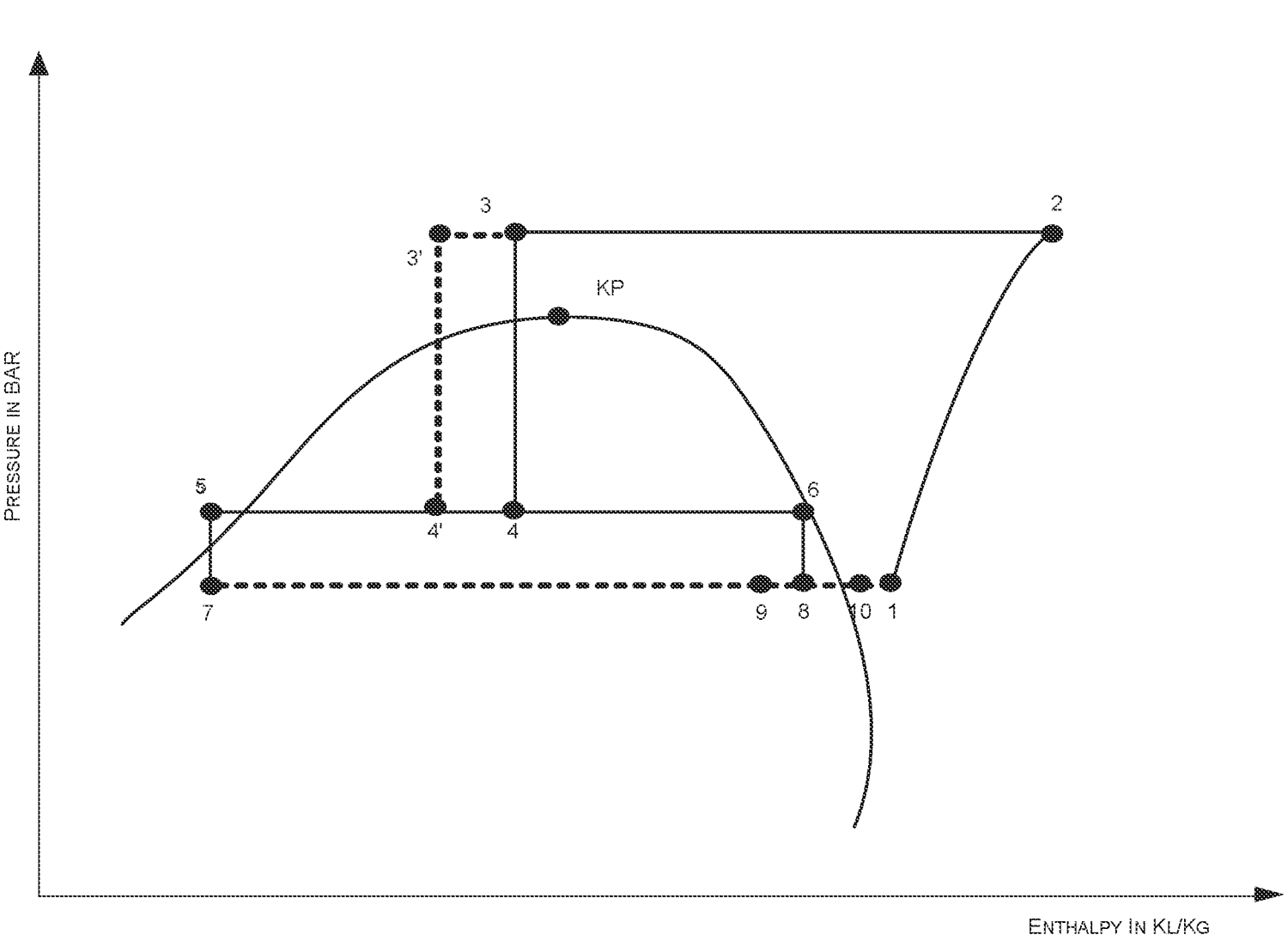
FIG. 3C illustrates an exemplary PH diagram of the refrigeration circuit of FIGS. 3A and 3B, wherein the dotted lines are indicative of winter conditions.

Accordingly, in one or more embodiments, when the temperature at the outlet of the gas-cooler 104 exceeds a predefined temperature (such as an ambient temperature) or when the electricity pricing is above the predefined level (electricity is expensive), the buffer of the thermal battery 110 acting as the heat sink may be melted to cool the refrigerant by allowing the refrigerant to flow through the thermal battery 110. The cooled refrigerant may then exit the first outlet of the thermal battery 110 and be supplied to the outlet of the gas-cooler 104 via the three-way valve 112 to reduce the temperature at the outlet of the gas-cooler 104 below the ambient temperature. This may help reduce the flash vapor generated from the gas-cooler 104 as shown in FIGS. 2C and 3C. For instance, from 4-4', if the buffer is melted, the flash vapor may be removed or the entropy inlet of the expansion valve or HPV 116 may be reduced. Further, less flash vapor means from 6-8, there is less mass flow of vapor, which may be throttled to the level of the evaporation temperature of the empty compressor and therefore less compressor work may be needed to recompress this flash vapor gas amount.

In some embodiments, a simple expansion valve may be used to load the buffer, however, to optimize the refrigeration circuit 100 and installations, the cabinets or cold room evaporators 108 may be operated in dry expansion mode, which usually utilizes superheated gas at 6-8 Kelvin temperature. Still, a section of the evaporator 108 may be a super-heated section with low strength, so, the installations may be operated in a semi-flooded mode, where the installations are operated with a very low superheat control signal, which ends up in having 10% of liquid at the end of the evaporator, which is usually desirable because liquid refrigerant will damage the bearings in the compressor. To overcome the above limitations, the refrigeration circuit 100 may allow the thermal battery 110 to operate as a heat source to evaporate the overheated liquid, such that at the outlet of the thermal battery 110 may provide superheated gas, which is good for the compressors 102.

In one or more embodiments, when the electricity pricing is above the predefined level, the buffer acting as the heat sink may be melted to cool the refrigerant flowing therethrough to a second temperature. The cool refrigerant may then be supplied to the one or more evaporators 108 associated with the refrigeration installations. In the evaporator 108, heat may be transferred from the cabinet storage space to the cool refrigerant coming from the thermal battery 110, which may cause the refrigerant to heat and vaporize, and cool the storage space of the cabinets. Accordingly, the refrigeration circuit 100 can ramp up and ramp down simultaneously on multiple refrigeration installations, when the electrical load is either in the positive or the negative direction.

In one or more embodiments, in the evaporator 108, heat may be transferred from the cabinet storage space to the liquid refrigerant, which may cause the refrigerant to heat and vaporize. The heated refrigerant leaving the outlet of the evaporator 108 may be delivered to the compressors 102 through the thermal battery 110 where the buffer may store the heat and act as a heat source. Later on, the liquid/vapor refrigerant leaving the outlet of the flash tank 106 may be delivered through the thermal battery 110, where the temperature of the refrigerant may be further increased to vaporize the refrigerant using the heat stored in the thermal battery 110 (acting as heat source). Accordingly, the supply of heat by the thermal battery 110 may facilitate the heating of the refrigerant to a super-heated temperature, which may be supplied to the compressor unit 102, thereby reducing the load on the compressors 102 and improving the longevity of the compressors 102.

In one or more embodiments, the buffer of the thermal battery 110 may be a phase-changing material (PCM) such as but not limited to paraffin, however, water may also be used as the PCM since evaporation is maintained around minus eight to minus five degrees Celsius in the invention. Fresh water may be used without the need for brine or paraffin as PCM.

In one or more embodiments, the refrigeration circuit 100 may include a controller 122 operatively coupled to the components of the refrigeration circuit 100. The controller 122 may be configured to monitor one or more parameters associated with the refrigeration circuit 100 using flow meters installed in conduits (lines) used for fluidically connecting the components of the refrigeration circuit 100. Further, the controller 122 may involve pressure sensors and temperature sensors to monitor the temperature and pressure of the refrigerant within the refrigeration circuit 100. The controller 122 can include a communication unit that connects the controller 122 to the components of the refrigeration circuit 100 and an electrical grid. The controller 122 may be in communication with a database of one or more electric power service providers associated with the electrical grid.

The controller 122 is configured to receive, from the database, data pertaining to electricity pricing associated with the electrical grid connected to the refrigerant circuit. The controller 122 may accordingly control the operation of the components of the refrigeration circuit 100 to control the flow of a refrigerant associated with the refrigeration circuit 100 between one or more of the gas-cooler 104 and the thermal battery 110, the thermal battery 110 and the evaporator 108, and/or the thermal battery 110 and the compressor unit 102. For instance, when the electricity pricing is below a predefined level, the controller 122 enables the flash tank 106 to supply and evaporate the refrigerant in the thermal battery 110 to cool a buffer associated with the thermal battery 110. Further, when the temperature at the outlet of the gas-cooler 104 exceeds a predefined (ambient) temperature or when the electricity pricing is above the predefined level, the controller 122 may enable the melting of the buffer of the thermal battery 110 to cool the refrigerant flowing therethrough and supply the cooled refrigerant to the outlet of the gas-cooler 104 to reduce the temperature at the outlet of the gas-cooler 104 below the ambient temperature, thereby reducing flash vapor and reducing the load on the compressors 102.

Further, when the electricity pricing is above the predefined level, the controller 122 may enable the melting of the buffer acting to cool the refrigerant flowing therethrough and further enable the supply of the cooled refrigerant to the one or more evaporators 108. Furthermore, the controller 122 may be configured to enable the flow of the refrigerant being heated in the refrigeration circuit 100, through the thermal battery 110 to store the thermal energy received from the heated refrigerant in the buffer such that the thermal battery 110 acts as a heat source. Thus, the controller 122 may enable the thermal battery 110 to act as the heat source to heat the refrigerant flowing therethrough to a super-heated temperature; and supply the super-heated refrigerant from the thermal battery 110 to the compressor unit 102.

Thus, the refrigeration circuit provides an improved, reliable, and power-efficient refrigeration circuit having a thermal storage. The refrigeration circuit allows loading (cooling/freezing) of the buffer when electricity pricing is cheaper and may further allow the buffer to melt against the gas-cooler outlet to reduce the power consumption if the cost of electricity is high or if ambient conditions are on a peak period of the day. Peak periods are defined as times at which the electricity usage is greater than average. Moreover, the refrigeration circuit may allow a lift of evaporation temperature in the refrigeration circuit, which may improve the overall efficiency. In addition, the refrigeration circuit also allows the users to easily retrofit refrigeration cabinets (loads) and size the initial equipment smaller.

While the invention has been described with reference to exemplary embodiments, it will be understood by those skilled in the art that various changes may be made and equivalents may be substituted for elements thereof without departing from the scope of the invention as defined by the appended claims. Modifications may be made to adopt a particular situation or material to the teachings of the invention without departing from the scope thereof. Therefore, it is intended that the invention not be limited to the particular embodiment disclosed, but that the invention includes all embodiments falling within the scope of the invention as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

The invention claimed is:

1. A refrigeration circuit comprising:

a controller configured to monitor one or more parameters associated with the refrigeration circuit and control operation of the one or more components of the refrigeration circuit;

a gas-cooler comprising an inlet and an outlet;

a compressor unit comprising one or more compressors, wherein an outlet of the compressor unit is fluidically connected to the inlet of the gas-cooler;

one or more evaporators, each comprising an inlet, and an outlet, wherein the outlet of the one or more evaporators is fluidically coupled to the inlet of the compressor unit;

a flash tank fluidically connected between one or more of the gas-cooler and the compressor unit, and the one or more evaporators and the compressor unit, wherein the flash tank is fluidically coupled to the inlet of the one or more evaporators via a first heat exchanger; and one or more thermal batteries fluidically coupled to the gas-cooler, the flash tank, the compressor unit, and the one or more evaporators.

2. The refrigeration circuit of claim 1, wherein the controller is operatively coupled to one or more components of the refrigeration circuit.

3. The refrigeration circuit of claim 1, wherein the controller is in communication with a database associated with one or more electric power service providers, wherein the controller is configured to:

receive, from the database, data pertaining to electricity grid information comprising electricity pricing associated with an electrical grid connected to the refrigerant circuit; and control, based on the electricity grid information, the flow of a refrigerant associated with the refrigeration circuit between one or more of the gas-cooler and the thermal battery, the thermal battery and the one or more evaporator, and/or the thermal battery and the compressor unit.

4. The refrigeration circuit of claim 3, wherein when temperature at the outlet of the gas-cooler exceeds a predefined temperature and/or when the electricity pricing is above the predefined level, a buffer of the thermal battery acting as a heat sink is melted to cool the refrigerant flowing therethrough, wherein the cooled refrigerant is supplied to the outlet of the gas-cooler to reduce temperature at the outlet of the gas-cooler below an ambient temperature.

5. The refrigeration circuit of claim 3, wherein when the electricity pricing is above the predefined level, the controller enables melting of a buffer acting as a heat sink to cool the refrigerant flowing therethrough to a second temperature and further supply the cooled refrigerant to the one or more evaporators.

6. The refrigeration circuit of claim 1, wherein at least one of the one or more thermal batteries further comprises a first inlet, a first outlet, a second inlet, and a second outlet.

7. The refrigeration circuit of claim 1, wherein the outlet of the gas-cooler is fluidically coupled to an inlet of at least one of the one or more thermal batteries via a second heat exchanger.

8. The refrigeration circuit of claim 1, wherein the outlet of the gas-cooler is fluidically coupled to an inlet of at least one of the one or more thermal batteries via a second heat exchanger and a third heat exchanger.

9. The refrigeration circuit of claim 1, wherein the flash tank is fluidically coupled to an inlet of the compressor unit via the first heat exchanger.

10. A refrigeration circuit comprising:

a gas-cooler;

a compressor unit comprising one or more compressors;

one or more evaporators;

a flash tank, wherein the flash tank is fluidically coupled to an inlet of the one or more evaporators via a heat exchanger; and one or more thermal batteries fluidically coupled to the gas-cooler, the flash tank, the compressor unit, and the one or more evaporators.

11. The refrigeration circuit according to claim 10, wherein the flash tank is fluidically connected between one or more of the gas-cooler and the compressor unit, and the one or more evaporators and the compressor unit.

12. The refrigeration circuit according to claim 10, wherein an outlet of the compressor unit is fluidically connected to an inlet of the gas-cooler.

13. The refrigeration circuit according to claim 11, wherein an outlet of the compressor unit is fluidically connected to an inlet of the gas-cooler.

14. The refrigeration circuit according to claim 10, further comprising a controller configured to:

control, based on electricity grid information, a flow of a refrigerant associated with the refrigeration circuit between one or more of the gas-cooler and the thermal battery, the thermal battery and the one or more evaporator, and/or the thermal battery and the compressor unit.

15. A refrigeration circuit comprising:

a gas-cooler;

a compressor unit comprising one or more compressors;

one or more evaporators;

a flash tank; and one or more thermal batteries fluidically coupled to the gas-cooler, the flash tank, the compressor unit, and the one or more evaporators, wherein at least one of the one or more thermal batteries further comprises a first inlet, a first outlet, a second inlet, and a second outlet.

16. The refrigeration circuit according to claim 15, wherein the flash tank is fluidically connected between one or more of the gas-cooler and the compressor unit, and the one or more evaporators and the compressor unit.

17. The refrigeration circuit according to claim 15, wherein an outlet of the compressor unit is fluidically connected to an inlet of the gas-cooler.

18. The refrigeration circuit according to claim 16, wherein an outlet of the compressor unit is fluidically connected to an inlet of the gas-cooler.

19. The refrigeration circuit according to claim 15, further comprising a controller configured to:

control, based on electricity grid information, a flow of a refrigerant associated with the refrigeration circuit between one or more of the gas-cooler and the thermal battery, the thermal battery and the one or more evaporator, and/or the thermal battery and the compressor unit.

20. A method of using the refrigeration circuit according to claim 10, the method comprising:

controlling, based on electricity grid information, a flow of a refrigerant associated with the refrigeration circuit between one or more of the gas-cooler and the thermal battery, the thermal battery and the one or more evaporator, and/or the thermal battery and the compressor unit.

* * * * *